US006686573B2

(12) United States Patent
Behnke et al.

(10) Patent No.: US 6,686,573 B2
(45) Date of Patent: Feb. 3, 2004

(54) PROCESS AND DEVICE FOR WARMING UP PRINTING MATERIAL AND/OR TONER

(75) Inventors: Knut Behnke, Kiel (DE); Hans-Otto Krause, Eckernförde (DE); Frank-Michael Morgenweck, Molfsee (DE); Domingo Rohde, Kiel (DE); Detlef Schulze-Hagenest, Molfsee (DE); Gerhard Bartscher, Köln (DE); Kai-Uwe Preissig, Dortmund (DE); Dinesh Tyagi, Fairport, NY (US)

(73) Assignee: NexPress Solutions LLC, Rochester, NY (US)

( * ) Notice: Subject to any disclaimer, the term of this patent is extended or adjusted under 35 U.S.C. 154(b) by 134 days.

(21) Appl. No.: 10/008,852

(22) Filed: Dec. 4, 2001

(65) Prior Publication Data

US 2002/0088798 A1 Jul. 11, 2002

(30) Foreign Application Priority Data

Dec. 22, 2000 (DE) ..... 100 64 565
Sep. 12, 2001 (DE) ..... 101 45 003

(51) Int. Cl.[7] ..... H05B 6/80
(52) U.S. Cl. ..... 219/679; 219/692; 399/336

(58) Field of Search ..... 219/679, 692, 219/691, 693, 216, 695, 746, 388, 750; 399/335, 336, 337; 347/102

(56) References Cited

U.S. PATENT DOCUMENTS

| | | | | | |
|---|---|---|---|---|---|
| 4,456,368 | A | * | 6/1984 | Isaka et al. | 399/336 |
| 4,482,239 | A | * | 11/1984 | Hosono et al. | 399/336 |
| 4,511,778 | A | | 4/1985 | Takahashi et al. | 219/691 |
| 4,542,980 | A | * | 9/1985 | Tajima | 399/336 |
| 5,536,921 | A | | 7/1996 | Hedrick et al. | 219/693 |
| 5,631,685 | A | * | 5/1997 | Gooray et al. | 347/102 |

* cited by examiner

*Primary Examiner*—Quang T. Van
(74) *Attorney, Agent, or Firm*—Lawrence P. Kessler

(57) ABSTRACT

A process or device for fusing toner on a carrier or a printing material, particularly a sheet-type printing material, preferably for a digital printer, wherein the printing material with the toner is irradiated with microwaves from at least one microwave conductor, which is heated to melt the toner and a toner is used which shows a sharp drop of the elastic modulus G' from its hard state to its liquid state when heated. The ratio of the value of the elastic modulus G' of the toner is the reference temperature value calculated from the initial temperature at the beginning of the glass transition of the toner plus 50° C. to the value of the elastic modulus G' at the initial temperature is $<10^{-5}$.

16 Claims, 3 Drawing Sheets

PROCESS AND DEVICE FOR WARMING UP PRINTING MATERIAL AND/OR TONER

FIELD OF THE INVENTION

The invention relates to a process for fusing toner on a carrier or on a printing material, particularly on a sheet-type or a tape-type printing material, preferably for a digital printer.

Furthermore, the invention relates to a device for heating printing material and/or toner, particularly to fuse toner on a carrier or printing material, particularly a sheet-type or tape-type, preferably for a digital printer, preferably for performing the above-mentioned process.

BACKGROUND OF THE INVENTION

With digital printing, particularly electrostatic or electrophotographic printing, a latent electrostatic image is produced, which is developed by the loaded toner particles, which, on their part, are transferred onto a printing material receiving the image, e.g. paper. There the image transferred to the printing material is fused by heating and softening of the toner and/or heating of the printing material. By, and during, this process the toner particles are fused on the printing material and, if necessary, also on each other.

The use of microwaves is known for the fusing of toner on the printing material. Since the absorption of microwave energy in the toner is usually at least one order of magnitude smaller than that in the printing material, the printing material is preferably heated by the microwaves and the printing material heats on its behalf the toner found thereupon, and indeed up to a temperature that fuses the toner on the printing material. It is well known that, with the use of microwaves for fusing the toner, characteristic values of the printing material used, such as weight, moisture and composition are critical and must be taken into consideration.

Thus, for example, an image-fusing device is known from U.S. Pat. No. 4,511,778, which fuses a toner image on a printing material, particularly a sheet of paper, by high frequency waves, particularly microwaves. One aspect of the known device is the possibility of producing the microwaves as a function of the size of the printing material, so that, by taking this size into consideration as a characteristic value of the printing material, an appropriate melting and fusing of the toner is ensured. This is a process that is quite general and only takes into consideration an immediately obvious size of the printing material, which is determined prior to the fusing thereof for the operation of the device, possibly according to a consideration that a larger piece to be heated, due to its greater heating capacity, requires all in all more energy than a smaller piece to be heated.

Due to this general guideline, however, other critical aspects for the use of microwaves for fusing the toner are ignored. Thus, for example, the cited process is only applicable to black and white printing with a paper weight within only a small range of widths, while the possibly different behavior of a multicolor toner with different paper weights, which may also have different water contents, are not taken into consideration in this general process, which is determined by the size of the printing material. With color printing, the toner may, for example, have four different toner layers. Here, the maximum thickness of each toner layer on the image-carrying substrate or printing material is 100%, whereby a maximum total weight of the toner layers in the toner image is 400%. The thickness of a single color customarily lies in the range of 0% to 100% thickness, and a color toner image is in the range of 0% to 290%.

Furthermore, with the use of sheet-type printing material, the problem may arise that the edge of the sheet that has been irradiated with microwaves may be energetically processed in a different manner than the middle section of the sheet. This may result in a printed product that is uneven.

In addition, the fusing of conventional toner using only microwaves under such conditions only results in an incomplete melting of the toner, depending on its layer thickness, or it results in heating with blistering in areas of the toner. In addition, the fusing of the toner on the printing material is insufficient under the circumstances, because, for example, the fusing of the toner on the printing material is insufficient due to the fact that viscosity of the melted toner is too high. Problems can occur then, especially if a printing material is printed in two successive printing processes on both sides.

Due to the possible occurrence of the problems described, the use of microwave irradiation is usually not trusted for fusing the toner, but the toner is in practice heated without microwave irradiation and is fused on the printing material with a pair of heated, pressurized rollers. However, contact-free fusing is principally desired for preservation of the printed image. Other advantages of the contact-free fusing are the prevention of adhesive wear and tear and the increased service life of the device used as well as ensuring a better reliability of the device.

SUMMARY OF THE INVENTION

The desire of this invention is to make adequate fusing of the toner on a printing material, or its preparation, using microwaves possible, preferably also for multicolor printing on sheet-type printing material and preferably with adjustment to the prevailing special conditions.

With respect to the process, it is provided according to the invention, that the printing material with toner is irradiated with microwaves from at least one microwave conductor, which is heated to melt the toner and that a toner is used that shows a quick transition from its solid state to its liquid state when heated.

In this process according to the invention, a dry toner can be used, for example, that is still quite solid at a medium temperature of some 50° C. to 70° C., so that, by a conventional process, it can be ground to a desired medium toner size of 8–4 micrometers. For example, said dry toner is not yet sticky and does not melt at development temperatures, but already flows very easily and has a lower viscosity at higher temperatures of some 90° C. Thus, if used with capillaries, the dry toner can be fused and adheres without outside pressure and contact-free on the printing material, and when cooled, it becomes hard again and is fused. It has indeed a good surface luster suitable for the printing material, and, in particular, without developing grain boundaries. The latter already also plays a significant roll in the color saturation with color toner.

With this process, in connection with the toner according to the invention, the ratio of the values of the elastic modulus G' at the reference temperature value can be calculated from the initial temperature at the beginning of the glass transition of the toner plus 50° C. to the value of the elastic modulus at the initial temperature itself <1E-5, preferably even <1E-7, whereby E represents the exponent on base 10. The initial temperature at the beginning of the glass transition of the toner is preferably determined as that temperature value at which the tangents to the functional behavior of the elastic modulus G' intersect as a function of the temperature before and after the glass transition. The glass transition of the toner from its hard state to its liquid state preferably takes place in a temperature interval or temperature window of approximately 30° C. to 50° C. order of magnitude. This range should lie above 60° C., preferably between approximately 70° C. to 130° C., and most preferably between 75° C. and 125° C.

Another embodiment of the process according to the invention is distinguished in its adaptation to special ratios, in that at least one physical process parameter is controlled and/or regulated as a function of a parameter correlating to the energy charge in the printing material with toner. According to this aspect of the invention, a simple general guideline is thus not envisaged, but advantageously a control regulated to the actual, preferably measured ratio. Here the abovementioned energy charge basically corresponds to a microwave power received from the total system of the printing material and toner, so that, according to the invention, corresponding to the actual ratios, the power transmitted is compared and regulated with the power received. This basically corresponds in turn to an efficiency control and/or regulation. Here it is generally considered, in particular, to have a control on the side of the transmitter in the widest sense, which can also be considered to be a microwave source, and/or on the side of the receiving toner-printing material system, or the use of one.

To this end, the invention recommends that it is preferable to regulate the power of the microwave conductor and/or regulate the movement speed of the printing material and/or to regulate the frequency of the microwaves. The latter measure is preferable to achieve a higher energy absorption directly in the toner itself, and thereby a more precise effect on its fusion than can be achieved indirectly and problematically with the printing material. The invention recommends the temperature of the printing material or the microwave energy reflected from the toner-printing material system, and which is thus unabsorbed, as the measurable parameter for the dependent regulation. Other measurable parameters could be, but are not limited to, the weight/the thickness or the water content of the printing material or the density and luster of the toner layer.

In principle, all frequencies of the microwave range from 100 MHz to 100 GHz can be used. As a rule, the ISM frequency released for industrial, scientific or medical utilization, particularly 2.45 GHz, is used. A use of other frequencies in the known frequency range may, however, advantageously lead to a situation where a greater portion of radiant energy is absorbed than usual from the toner and not only from the printing material. Separate protection is required for a device of the type mentioned, which is distinguished in its independent solution of the task at hand, in that at least one transmitter is envisaged that transmits microwaves, whereby, for the purpose of irradiation and heating, the toner has a quick transition from its hard state to its liquid state when heated. To this end, one or more adjustable operating parameters are preferably envisaged.

Another embodiment of the device according to the invention is distinguished by at least one microwave conductor with a meandering or serpentine course. The structure of the microwave conductor according to this aspect of the invention has the advantage that a relatively large microwave conductor length is made available as the interaction length with the printing material for the continuous wave field for the application of the microwave energy. To this end, the microwave conductor is preferably conducted repeatedly back and forth crosswise to the transport direction over the transport route for the printing material. In this manner, a uniform and homogenous heating of the printing material with high efficiency is achieved.

The meandering shape can be relatively compactly prepared such that the meandering section is densely packed together. In addition, the microwave conductor width for a corresponding increase of the field strength can be reduced. A compact configuration is particularly desirable with a printing of the printing material in the face printing and the reverse printing and the required fusing of the respective toner image for this purpose. Depending on the microwave energy supplied, the maximum field strength should be 3 kV/mm, preferably approximately 0.2 kV/mm to approximately 1.0 kV/mm.

With each passage through a meandering segment, the electric field strength E decreases based on the absorption through the printing material and respectively, the toner image. Since the absorption is not linearly dependent ($\sim E^2$) on the electric field strength and is linearly dependent on the respective width of the microwave conductor, the decreasing field strength can be partially compensated by a suitable successive reduction of the width of the successive meandering segments. Preferably, a compensation can take place in addition or instead of by a suitable convergent or conical passage of the width of the microwave conductor. The goal in each case is an extensive constant electric field strength over the length of the microwave conductor and particularly also within the meandering segment. This likewise can be achieved through the abovementioned convergent passage. In addition, these measures reduce the size of the meandering in the transporting or processing direction.

In addition, the decrease of the absorption inside a meandering segment can be partially compensation by the convergent passage. To this end, the convergent geometry is configured in such a way that a smaller electric field strength prevails at the beginning than at the end of the meandering segment. Since the absorption is not linearly dependent ($\sim E^2$) on the electric field strength and is linearly dependent on the respective width of the microwave conductor, a suitable ratio of the microwave conductor width and the electric field strength with extensive constant absorption can be found over the length of the meandering segment.

The transport direction of the printing material can occur in both directions perpendicular to the extent of the meandering segments, however, the microwave power must be taken into consideration and adjusted accordingly with the feeding and discharge of the printing material. The number of meandering segments is dependent upon the necessary power absorption and upon the temperature of the printing material and the homogeneity of its heating and drying.

The device according to the invention is not only just suitable fuser, but it could also be advantageously used as a preheating device. It would also be suitable as a conditioning device for conditioning the printing material, particularly paper. A change of the printing material can then readily take place by the application of heat prior to the printing process. The device according to the invention is preferably envisaged for a digital multicolor printer.

BRIEF DESCRIPTION OF THE DRAWINGS

In the detailed description of the preferred embodiment of the invention presented below, reference is made to the accompanying drawings, in which.

Possible embodiments of the invention are given below together with five figures, from which other measures according to the invention are produced, although the invention is not limited to the examples or figures herein.

DETAILED DESCRIPTION OF THE INVENTION

The G' ratio is the ratio of the elastic modulus G' at the initial temperature of the glass transition plus 50° C. to G' at the initial temperature of the glass transition. The initial temperature of the glass transition is determined according to FIG. 1 from the intersection of the tangents to G' before and after the glass transition and lies in the illustrated example close to 70° C.

Figure 1:
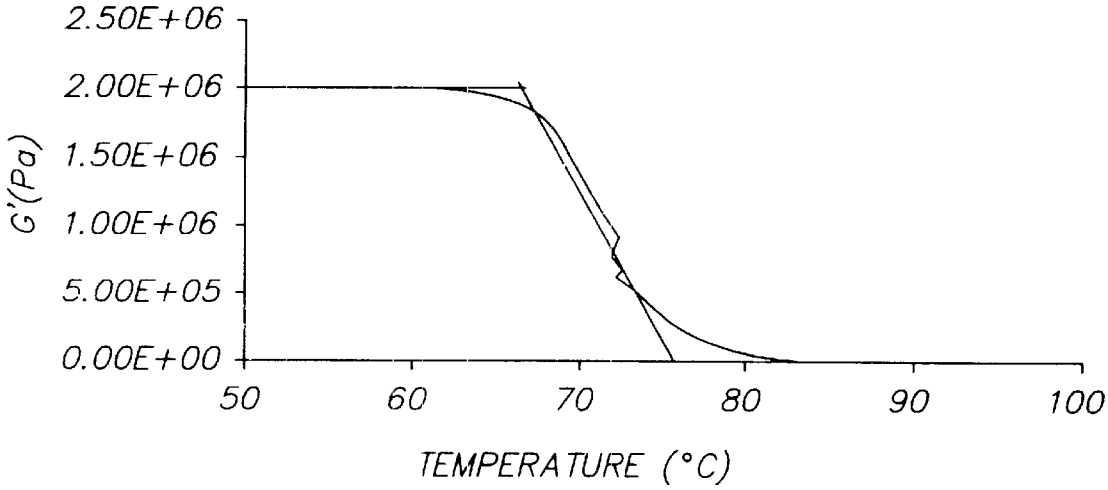
FIG. 1 which represents the functional behavior of the elastic modulus G' of a toner as a function of the temperature for the determination of the initial temperature of the glass transition of the toner, FIG. 2 which represents the measured functional behavior according to FIG. 1 of the toner according to the invention and two state-of-the-art toners for comparison purposes, FIG. 3 which is a schematic top view of a microwave conductor according to the invention, FIG. 4 which is a side view of the microwave conductor according to FIG. 3.
Figure 2:
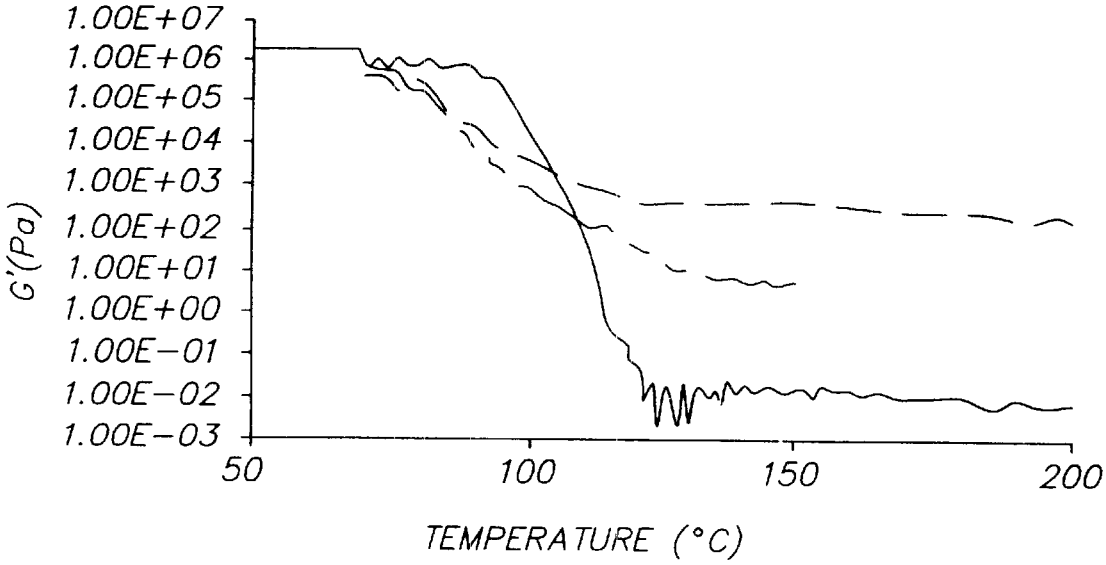

In FIG. 2, the measured functional behavior of G' according to FIG. 1 for three exemplary toners is shown. The functional values of G' were determined by a rheological measurement with a Bolin rheometer fitted with parallel plates with a diameter of 40 mm. A continuous temperature change at a frequency of 1 rad/s corresponding to 0.16 Hz between 50° C. and 200° C. was carried out. The strain of the measured toner was selected in such a way that the probe showed no lessening of the feed (Newton's behavior). Only the toner according to the invention shows a quick transition from the hard to the liquid state with an end G' value of approximately 1.00E-02. This results in a G' ratio of 5.OE-08.

Figure 3:
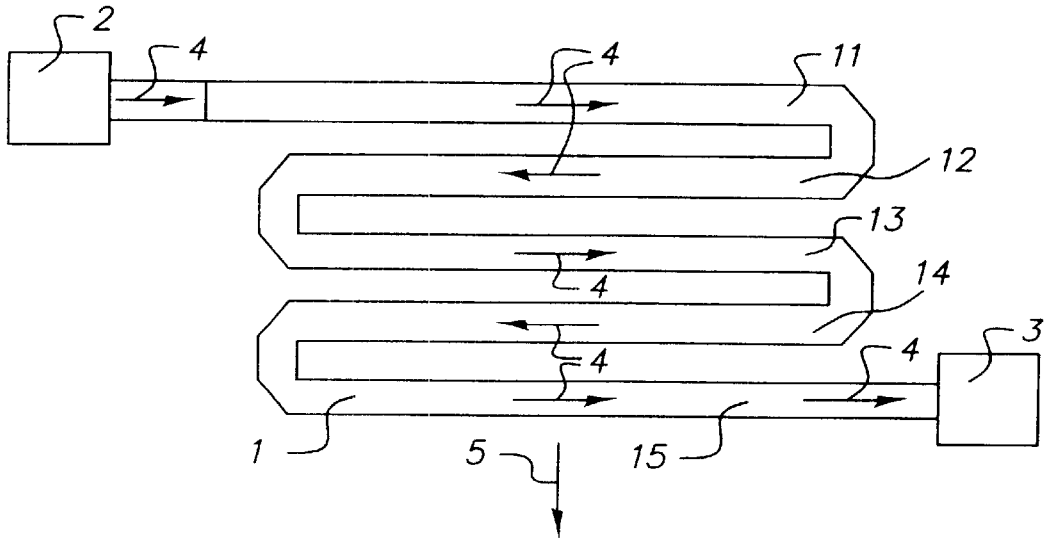

FIG. 3 shows schematically in the top view a meandering or serpentine-shaped microwave conductor 1 that is connected at one of its ends to a system 2 for the production of microwaves and by its other end to a system 3 for the sealing of the microwave conductor and which continues through the microwaves in the direction of arrow 4. The meandering shape has meandering segments 11 to 15 that are parallel to one other, which extend crosswise to a transport direction 5 for a printing material. In FIG. 3, the meandering segments each have the same width. From the successive meandering segments 11 to 15, however, each following meandering segment in the transport direction 5 may have a smaller width in comparison to the preceding one and/or each meandering segment may be narrower convergently or conically in its course, in order to ensure an approximately constant electric field strength over the entire length of the microwave conductor 1 and/or the meandering segments despite microwave absorption through the printing material that has not been illustrated in greater detail.

Figure 4:
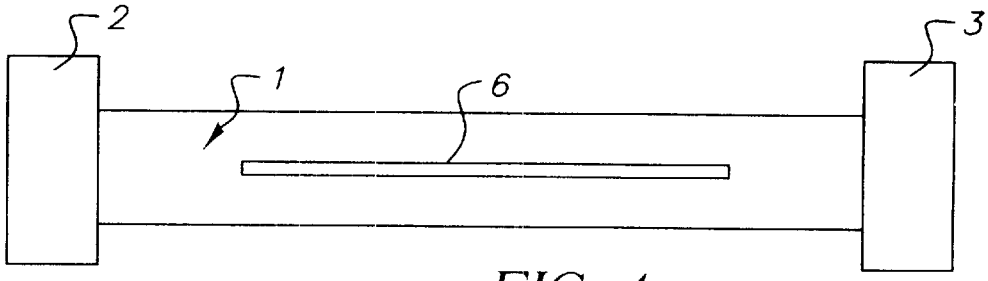

FIG. 4 shows a side view of the arrangement according to FIG. 3. The same structural elements are shown as well as in the following FIG. 5, with the same reference numbers as in FIG. 3.

In FIG. 4 can be seen a cutaway 6 for the printing material in the microwave conductor 1.

Figure 5:
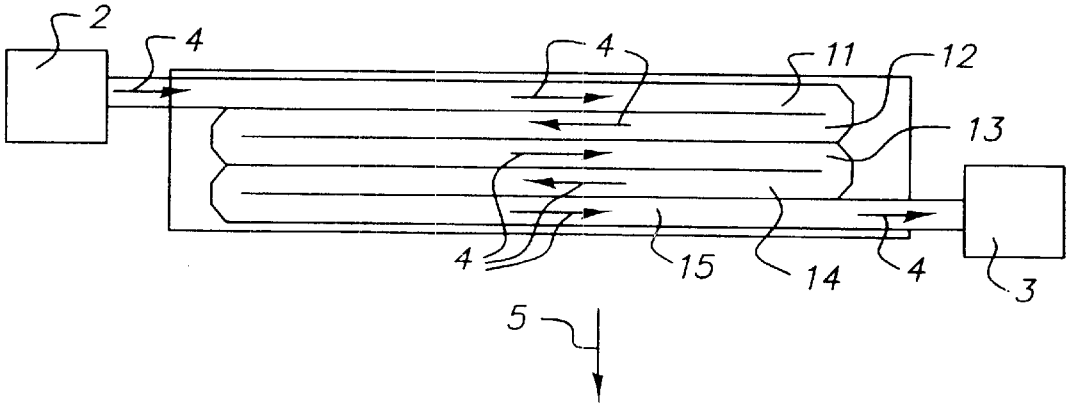
FIG. 5 which is a second meandering-shaped microwave conductor in the top view with a particularly compact configuration.

FIG. 5 shows a microwave conductor 1 corresponding to the microwave conductor 1 in FIG. 3, however, in a particularly compact configuration with the meandering segments 11 to 15 being immediately pushed together.

The invention has been described in detail with particular reference to certain preferred embodiments thereof, but it will be understood that variations and modifications can be effected within the spirit and scope of the invention.

What is claimed is:

1. Process for fusing toner on a carrier or a printing material, particularly a sheet-type printing material, comprising the steps of:

irradiating the printing material with toner by at least one microwave conductor and which is heated for melting the toner, and a toner is used that shows a sharp drop of the elastic modulus G' from its hard state to its fluid state when heated, the ratio of the values of the elastic modulus G' at a reference temperature value, calculated from the initial temperature at the beginning of the glass transition of the toner plus 50° C. to the value of the elastic modulus at the initial temperature is $<10^{-5}$, is preferably $<10^{-7}$.

2. Process according to claim 1, wherein the transition of the toner from its hard to its fluid state occurs in a temperature interval of approximately 50° C. or lower.

3. Process according to claim 2, wherein the above-mentioned temperature interval of the change in the state of the toner above 60° C. preferably extends in the range from approximately 75° C. to approximately 125° C.

4. Process for attaching a toner, particularly according to claim 1, wherein at least one physical process parameter is controlled and adjusted as a function of a parameter correlating to the printing material with the energy charge in the toner.

5. Process according to claim 4, wherein the power of the microwave conductor is regulated as a function of the energy charge in such a way that when the energy charge is low, the power increases and when the energy charge is high, the power is reduced, in order to keep a basically constant, suitable energy charge on the average.

6. Process according to claim 4, wherein the movement speed of the printing material is regulated by a range irradiated with the microwaves as a function of the energy charge in such a way that when the energy charge of the printing material is low, it is fused with a lower speed and that when the energy charge of the printing material is high, it is fused with a higher speed.

7. Process according to claim 4, wherein the microwave conductor is regulated as a function of the energy charge or in accordance with the frequency of the microwaves it transmits.

8. Process according to claim 4, wherein the temperature of the printing material is taken as the parameter correlating to the energy charge.

9. Process according to one of the claim 4, wherein the efficiency of the energy charge is taken as the parameter correlating to the energy charge.

10. Process according to claim 4, that wherein a frequency is selected that is in a microwave frequency range of 100 MHz to 100 GHz taken from the released ISM frequencies, whereby the portion of the absorption of the microwave energy measured by the toner in comparison with the total absorption is selected in favor of a higher absorption.

11. Process according to claim 4, wherein a color toner is used.

12. Device for heating of the printing material and/or toner, particularly for fusing the toner on a carrier or printing material, particularly a sheet-type printing material, characterized in that, comprising:

at least one microwave conductor for the irradiation and heating of a toner with a sharp drop of the elastic modulus G' from its hard state to its liquid state when heated, the microwave conductor has a maximum electric field strength of approximately 3 kV/mm, preferably from approximately 0.2 kV/mm to approximately 1.0 kV/mm.

13. Device according to claim 12, wherein at least one of the physical operating parameters affecting the irradiation is adjustable as a function of a parameter correlating to the energy charge in the toner-printing material arrangement.

14. Device for the heating of the printing material and/or toner according to claim 13, wherein a microwave conductor has a meandering or serpentine shaped course.

15. Device according to claim 14, wherein the microwave conductor has meandering windings or segments that extend back and forth substantially in a plane parallel to the transport direction of the printing material and transverse to the transport direction.

16. Device according to claim 15, wherein the meandering segments are compactly arranged bordering one another.

* * * * *